US006257785B1

(12) United States Patent
Otten et al.

(10) Patent No.: US 6,257,785 B1
(45) Date of Patent: Jul. 10, 2001

(54) SEMI-ENCLOSED APPLICATOR UTILIZING A SELECTIVELY-ACTIVATIBLE SHEET MATERIAL FOR DISPENSING AND DISPERSING A SUBSTANCE ONTO THE SURFACE OF A TARGET OBJECT

(75) Inventors: Geneva G. Otten; Richard Tweddell, III, both of Cincinnati; Kenneth S. McGuire, Wyoming; Peter W. Hamilton, Cincinnati, all of OH (US)

(73) Assignee: The Procter & Gamble Company

( * ) Notice: Subject to any disclaimer, the term of this patent is extended or adjusted under 35 U.S.C. 154(b) by 0 days.

(21) Appl. No.: 09/369,742

(22) Filed: Aug. 6, 1999

(51) Int. Cl.[7] ..... A46B 5/04
(52) U.S. Cl. ..... 401/7; 401/261; 401/264
(58) Field of Search ..... 401/7, 266, 261, 401/201, 264, 25; 15/227, 104.93, 104.94

(56) References Cited

U.S. PATENT DOCUMENTS

| | | | | |
|---|---|---|---|---|
| 3,768,916 | | 10/1973 | Avery | 401/132 |
| 3,929,135 | | 12/1975 | Thompson | 128/287 |
| 4,081,256 | | 3/1978 | Donnelly | 62/4 |
| 4,324,246 | | 4/1982 | Mullane et al. | 128/287 |
| 4,342,314 | | 8/1982 | Radel et al. | 128/287 |
| 4,430,013 | | 2/1984 | Kaufman | 401/132 |
| 4,670,930 | | 6/1987 | Lu | 15/118 |
| 4,775,372 | * | 10/1988 | Wilberg | 401/7 |
| 4,878,775 | | 11/1989 | Norbury et al. | 401/132 |
| 4,902,283 | | 2/1990 | Rojko et al. | 604/290 |
| 4,928,322 | | 5/1990 | Bradfield | 2/169 |
| 4,953,250 | | 9/1990 | Brown | 15/104.94 |
| 4,959,881 | | 10/1990 | Murray | 15/227 |
| 5,090,832 | | 2/1992 | Rivera et al. | 401/132 |
| 5,454,207 | | 10/1995 | Storandt | 53/410 |
| 5,473,789 | | 12/1995 | Oster | 15/104.94 |
| 5,616,201 | | 4/1997 | Finch et al. | 156/73.1 |
| 5,658,084 | | 8/1997 | Wirt | 401/132 |
| 5,738,212 | | 4/1998 | Pollard et al. | 206/362 |
| 5,806,099 | | 9/1998 | Grinberg | 2/158 |
| 5,829,089 | | 11/1998 | Steadman | 15/227 |
| 5,867,829 | | 2/1999 | Hegoas et al. | 2/159 |
| 5,904,151 | * | 5/1999 | Gueret | 401/266 |
| 5,925,160 | | 7/1999 | Sakoske | 65/60.5 |
| 6,018,837 | * | 2/2000 | Andreu | 15/104.94 |

FOREIGN PATENT DOCUMENTS

| | | | |
|---|---|---|---|
| 3545926 A1 | 7/1987 | (DE) | D06N/7/00 |
| 0 291 284A2 | 11/1988 | (EP) | B05C/17/00 |
| 0 291 284B1 | 11/1988 | (EP) | B05C/17/00 |
| 0 294 189A2 | 12/1988 | (EP) | B65D/47/42 |
| 2 754 744 | 4/1998 | (FR) | B05D/1/28 |

* cited by examiner

*Primary Examiner*—David J. Walczak
(74) *Attorney, Agent, or Firm*—Leonard W. Lewis

(57) ABSTRACT

A semi-enclosed, substance delivery applicator comprising: (a) a three-dimensional structure having outermost surface features and spaces between the outermost surface features for containing a substance, the substance having a level internal to the outermost surface features such that the substance is protected from inadvertent contact with external surfaces, the three-dimensional structure forming at least a portion of a semi-enclosed applicator body having at least one opening and an internal cavity; and (b) a substance, having substantial resistance to flow prior to delivery to a target surface, occupying the spaces of the three-dimensional structure, the substance remaining protected until the three dimensional structure is sufficiently deformed into a substantially two dimensional structure and the substance is thereby exposed to contact a surface of an object without compliance of the surface being necessary, the substance having an effective viscosity upon activation which permits the substance to be liberated from the location and dispensed onto the surface of the object. The substance may be dispensed inwardly of the applicator, outwardly of the applicator, or both. The applicator may take the form of a glove or mitt.

10 Claims, 2 Drawing Sheets

SEMI-ENCLOSED APPLICATOR UTILIZING A SELECTIVELY-ACTIVATIBLE SHEET MATERIAL FOR DISPENSING AND DISPERSING A SUBSTANCE ONTO THE SURFACE OF A TARGET OBJECT

FIELD OF THE INVENTION

The present invention relates to a semi-enclosed applicator containing a substance for application to the surface of a target object. The target object may be placed within the applicator for application of the substance, or the applicator may be utilized as an implement with an extremity placed therein to apply the substance to a target object located externally of the applicator, or both. More particularly, the present invention relates to such applicators wherein the substance may be released from the applicator material and distributed upon the surface of the target object.

BACKGROUND OF THE INVENTION

In the art of dispensing, articles have been developed which are coated or impregnated with useful substances intended to be utilized when the article is contacted with a target surface. While there are advantages with having the substance present on or near the surface of such articles, there is often the drawback that the useful substance is unprotected and is subject to inadvertent contact before intended use. Inadvertent contact may lead to contamination of the substance, loss of the substance onto surfaces other than the desired target surface, and/or contamination of such other surfaces with the substance. Moreover, the use of such articles to manually apply a substance to a surface of an object frequently results in exposure of a user's hands to the substance. At the very least such a scenario results in a waste of product and is undesirable from an aesthetic standpoint and, at worst, results in excessive exposure of the user to potentially harmful, toxic, or otherwise undesirable substances.

More recently, sheet materials have been developed which utilize a threedimensional structure which is activatible by a user to deliver a substance onto a target surface. While such sheet materials are believed to provide many advantages in relation to other types of delivery systems, the usefulness of non-structured sheets of material for certain applications is limited by the need of the user to grasp and control the sheet material during the process of applying the substance to the target surface. Depending upon the nature of the target surface and the substance to be applied, difficulties in controlling a generic sheet of material can lead to messiness and/or waste of the substance.

Accordingly, it would be desirable to provide an applicator for applying a substance to a target surface which permits greater control by the user during the application process.

It would also be desirable to provide such an applicator which permits the user to apply a substance to a target surface with reduced messiness and waste of the substance.

SUMMARY OF THE INVENTION

The present invention provides a semi-enclosed, substance delivery applicator comprising: (a) a three-dimensional structure having outermost surface features and spaces between the outermost surface features for containing a substance, the substance having a level internal to the outermost surface features such that the substance is protected from inadvertent contact with external surfaces, the three-dimensional structure forming at least a portion of a semi-enclosed applicator body having at least one opening and an internal cavity; and (b) a substance, having substantial resistance to flow prior to delivery to a target surface, occupying the spaces of the three-dimensional structure, the substance remaining protected until the three dimensional structure is sufficiently deformed into a substantially two dimensional structure and the substance is thereby exposed to contact a surface of an object without compliance of the surface being necessary, the substance having an effective viscosity upon activation which permits the substance to be liberated from the location and dispensed onto the surface of the object. The substance may be dispensed inwardly of the applicator, outwardly of the applicator, or both. The applicator may take the form of a glove or mitt.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

As used herein, the term "hand article", refers to a covering for the hand or portion of the hand such as a finger or thumb. The term "disposable" is used herein to describe hand articles which are not intended to be restored or reused (i.e., they are intended to be discarded after a single use, and preferably, to be recycled, composted or otherwise disposed of in an environmentally compatible manner). As used herein the term "glove" refers to a covering for the hand having separate sections for each finger. As used herein, the term "mitt" refers to a covering for the hand having an enclosure that leaves the fingers unseparated and that may include space for the thumb in the main enclosure, or provide space for the thumb in a separate enclosure for the thumb, or may not include a thumb enclosure at all. While the terms "glove" and "mitt" have been defined with respect to the human hand, similar structures could be utilized to cover or enclose other elements of human anatomy, such as foot coverings, head coverings, or condoms, or other items for which coverings of a particular shape are preferred. As used herein the term "dimple" means a depression or indentation on a surface. As used herein the term "extension force" refers to forces applied by hand movements to a surface to extend and/or bend that surface linearly and/or curvilinearly.

The term "semi-enclosed applicator" is intended to refer to an applicator device having at least one externally-accessible internal cavity for receiving an article to be treated or a portion of human anatomy such as a hand so that the applicator device may be used as an implement. A glove or mitt would be an example of such a semi-enclosed applicator in the context of the present invention. Semi-enclosed applicators frequently may be convertible to a fully-enclosed applicator via the use of a closure device, such that the internal cavity is fully-enclosed and no longer open to the outside. A storage bag with a sliding mechanical closure would be an example of a fully-enclosed structure similar to applicators in the context of the present invention.

Figure 1:
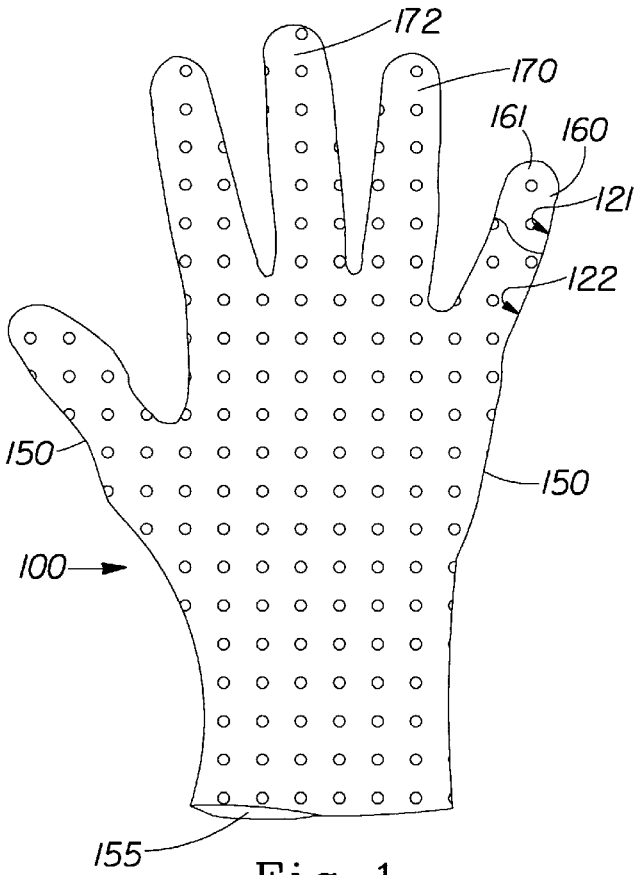
FIG. 1 is a plan view of a preferred embodiment of a semi-enclosed applicator in accordance with the present invention, in the form of a glove.

A preferred embodiment of a semi-enclosed applicator of the present invention in the form of a hand article is the disposable glove 100 shown in FIG. 1. FIG. 1 is a plan view of the glove 100 of the present invention in its flat-out state with portions of the glove 100 being cut-away to more clearly show the construction of the glove 100. The glove 100 comprises a front panel 160, a back panel 170, and a periphery 150 wherein front panel 160 and back panel 170 meet and preferably form a seamless connection. The term "seamless" refers to a surface having substantially no discernible grooves, ridges, indentations or any other irregular surfaces which would be readily discernible to the eye and/or touch. The front panel 160 has an inner surface 161 and an outer surface 162 (not shown) that is opposite to the inner surface 161. The back panel 170 has an inner surface (not shown) and an outer surface 172 that is opposite to the inner surface. As shown in FIG. 1, the glove is assembled such that the inner surfaces 161 and are positioned facing or adjacent to one another. The inner surfaces 161 and comprise that portion of the glove 100 positioned adjacent to a wearer's hand during use. Inner surface is meant to be worn adjacent to the back of a wearer's hand, and inner surface 161 is meant to be worn adjacent to the palm side or front of a wearer's hand. The outer surfaces 162 and 172 comprise those portions of the glove which are positioned away from the wearer's hand during use. The glove 10 shown in FIG. 1 comprises separate front and back panels 160 and 170, respectively, secured together about the periphery 150 to define an opening 155.

If desired, the glove 100 may be a differentially extensible hand article wherein at least a portion of the glove extends and/or contracts about a wearer's hand and/or wrist without the use of traditional elastic such as natural or synthetic rubber. By the term "differentially extensible" or "differential extensibility" it is meant herein to describe that quality of extensibility wherein portions of the glove extend or contract independently of other portions in response to varying hand sizes and motions. Preferably, this differential extensibility allows a range of hand sizes to fit comfortably within the glove. The glove 100 may be provided with differential extensibility by utilizing a structural elastic-like film web such as those described in commonly-assigned U.S. Pat. Nos. 5,518,801, issued to Chappell, et al. on May 21, 1996, and U.S. Pat. No. 5,650,214, issued Jul. 22, 1997 in the names of Anderson et al., and commonly-assigned, co-pending U.S. patent application Ser. No. 08/635,220, filed Apr. 17, 1996 in the names of Davis et al., entitled "Fitted Glove", the disclosures of each of which are hereby incorporated herein by reference. Alternatively, differential extensibility to fit varying sized hands comfortably can be accomplished by various elastic-like materials, composite materials that produce elastic-like characteristics and/or processes to make a material(s) more elastic-like. As used herein, the term "elastic-like" describes the behavior of web materials such as web materials which, when subjected to an applied elongation, extend in the direction of applied elongation. Also, when the applied elongation is released the web materials return, to a substantial degree, to their untensioned condition. The term "web" as used herein refers to a sheet-like material comprising a single layer of material or a laminate of two or more layers.

In use, a wearer inserts his/her hand into the glove 100 at the opening 155 thus partially to fully enclosing the hand. As the hand fits into the glove 100, the back panel 170 expands and contracts around the back of the hand as necessary to produce a snug, yet unconstricted, fit about a wearer's hand without the use of traditional elastics. As used herein, the term "snug" describes a close fit of the glove 100 that does not substantially restrict the motion of a wearer's hand. The term "unconstricted" as used herein refers to a type of resistance to extension that would not significantly impede or retard normal motion of one's hand.

In all glove embodiments disclosed herein, the first or inner surface of the back panel 170 and/or the second or outer surface of the front panel 160 can comprise a fibrous material such as paper or non-woven material which can function as an absorbent and/or a deliverer of embedded substances. Embedded substances can include surfactant, water, alcohol, lotion, antiperspirant, medicine, cleaning agents, bleach or any mixture of the foregoing.

In a preferred embodiment, the front panel 160 and the back panel 170 are fitted together such that there is a seamless construction at the periphery 150 which, when formed, comprises edge of connection 121 along the front panel 160 and edge of connection 122 along the back panel 170. This can be accomplished by many methods. One method is to graft an additional layer of polyethylene film over the periphery 150 (FIG. 1) and heat seal the graft in place. Another method is to overlap (i.e., fold over) the connection edges 121 and 122 such that the edges 121 and 122 do not connect to one-another but rather, connection edge 121 is sealed to the first surface of the back panel 170 and the connection edge 122 is sealed to the second surface of the front panel 160. This overlap method can be accomplished by heat sealing, adhesives and/or other attachment means known in the art for fitting together polyethylene films. Truly seamless unitarily formed gloves may also be formed by dipping a form into a liquid material and cooling or curing the material to form the finished product.

In accordance with the present invention, the semi-enclosed applicator represented by the glove 100 is at least partially comprised of a selectively-activatible sheet material which may be activated to deliver a substance initially protected from inadvertant contact to a surface of an object placed within the applicator, to an external surface or object when the applicator is utilized as an implement, or both. For example, an applicator in the form of a glove could apply a substance inwardly to condition or treat a hand while also serving to apply a substance outwardly onto external surfaces or objects for cleaning, polishing, or coating the surfaces or objects.

As utilized herein, the term "selectively activatible" is used to refer to materials which exhibit substantially nonactive properties when brought into contact with target surfaces until some action is taken by a user to "activate" the material to expose and dispense a substance. Accordingly, selectively-activatible properties differ from permanently-active strips of material which either maintain the substance in a permanently-deployed orientation or rely upon removal of liner materials (typically silicone-coated paper strips or films) or wrappings such as bags, boxes, or containers, to expose the substance for use.

Although materials in accordance with the present invention may be provided with two active sides or surfaces, if desired for particular applications, in accordance with the present invention it is presently preferred to provide such material with only one active side and one inactive or inert side. Under some circumstances it may be acceptable or desirable to design the sheet material so as to form an intermittent or discontinuous layer of substance on its active surface, while in other circumstances the sheet material be designed so as to exhibit a continuous layer of substance on its active side. For some applications it may also be desirable to provide multiple products on a single side of the material, deposited in discrete discontinuous cells or regions (e.g., co-dispensing epoxies, catalyzed reactions, etc.).

One such material of current interest for use in accordance with the present invention comprises a three-dimensional, conformable web comprising an active substance on at least one surface protected from external contact by the threedimensional surface topography of the base material. After activation, such materials form a substance delivery system which delivers the substance to the target surface. Such materials comprise a polymeric or other sheet material which is embossed/debossed to form a pattern of raised "dimples" on at least one surface which serve as stand-offs to prevent a substance therebetween or therein from contacting external surfaces until the stand-offs are deformed to render the structure more two-dimensional. Representative structures, as well as methods and apparatus for manufacturing them, are disclosed in commonly assigned U.S. Pat. Nos. 5,662,758, issued Sep. 2, 1997 to Hamilton and McGuire, entitled "Composite Material Releasably Sealable to a Target Surface When Pressed Thereagainst and Method of Making"; 5,871,607, issued Feb. 16, 1999 to Hamilton and McGuire, entitled "Material Having A Substance Protected by Deformable Standoffs and Method of Making"; 5,965,235, issued Oct. 12, 1999 to McGuire, Tweddell, and Hamilton, entitled "Three-Dimensional, Nesting-Resistant Sheet Materials and Method and Apparatus for Making Same"; 6,194,062, issued Feb. 27, 2001 to Hamilton and McGuire, entitled "Improved Storage Wrap Materials"; 5,968,633, issued Oct. 19, 1999 to Hamilton, McGuire, Tweddell, and Otten, entitled "Selectively-Activatible Sheet Material For Dispensing and Dispersing a Substance Onto a Target Surface"; and 6,099,940, issued Aug. 8, 2000 to Hamilton and McGuire, entitled "Selectively-Activatible Three-Dimensional Sheet Material Having Multi-Stage Progressive Activation to Deliver a Substance to a Target Surface". The disclosures of each of these patents and applications are hereby incorporated herein by reference.

Figure 2:
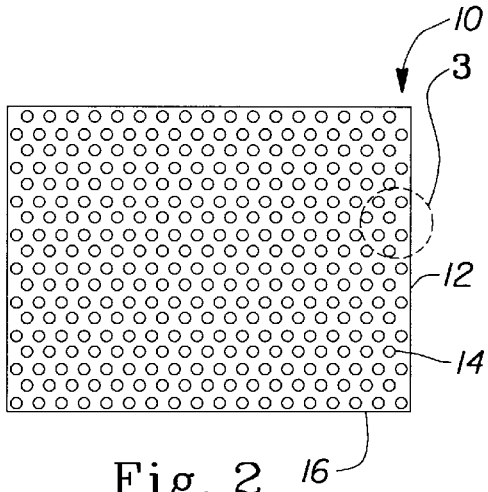
FIG. 2 is a plan view of a preferred embodiment of the present invention, disclosing a piece of material having truncated conical protrusions which protect a substance therein or therebetween from contact with external surfaces.
Figure 3:
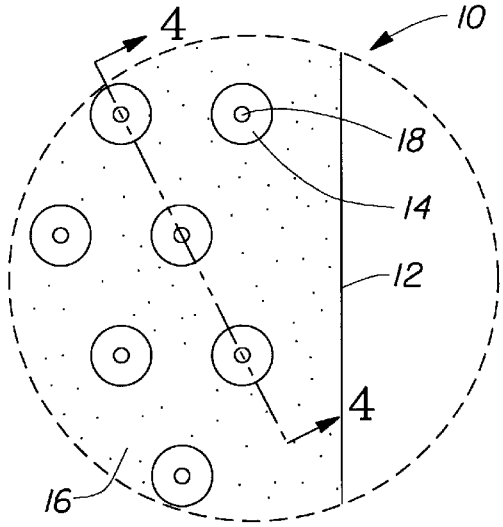
FIG. 3 is an enlarged partial plan view of the material of FIG. 2, showing an array of protrusions.
Figure 4:
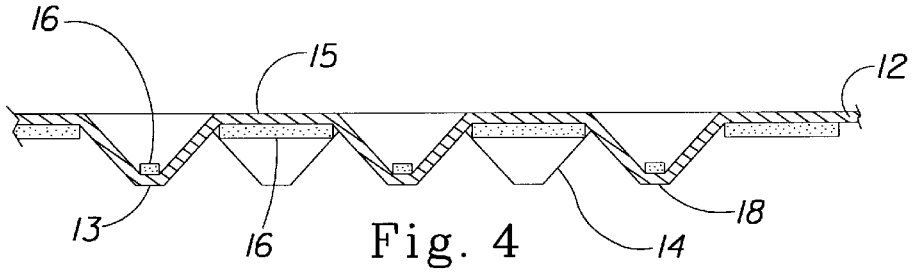
FIG. 4 is an elevational sectional view of the material of FIG. 3, taken along section line 4—4, showing the substance located on both sides of the formed material, both substances being protected by the same standoff protrusions.

FIGS. 2–4 illustrate a representative embodiment of a material useful in applicators according to the present invention, which comprises a three-dimensional sheet-like structure generally indicated as 10. Material 10 includes a deformed material 12 having hollow protrusions 14 and a layer of substance 16 located between protrusions 14. Protrusions 14 are preferably conical in shape with truncated or domed outermost ends 18. In the embodiment of FIGS. 2–4, protrusions 14 are equally spaced in an equilateral triangular pattern, all extending from the same side of the material. Preferably, the protrusions 14 have heights which are less than their diameters, so that when they deform, they deform by substantially inverting and/or crushing along an axis which is substantially perpendicular to a plane of the material. This protrusion shape and mode of deforming discourages protrusions 14 from folding over in a direction parallel to a plane of the material so that the protrusions cannot block substance between them from contact with a target surface.

In the configuration shown in FIG. 4, the substance 16 adheres to and partially fills the valleys between the plurality of hollow protrusions in the first side 13 of the piece of material and also fills the depressions in the second side 15 of the piece of material. The embodiment of FIG. 4 is representative of an optional configuration wherein both sides of the material are capable of dispensing a substance, while a substance could be omitted from one side or the other to create a configuration wherein only one side of the material carries and dispenses a substance. The substances on respective sides of the material in a dual-dispensing configuration could have the same or diverse compositions and characteristics.

With regard to the first side of the material, in the limiting circumstance, the substance fills the valleys to a point at or slightly below the highest point of the protrusions, particularly if a meniscus is formed wherein the substance decreases in thickness with increasing distance from the surface of the protrusions. The substance has a surface below the outermost ends of the plurality of hollow protrusions, so that when a portion of the first side of the piece of deformable material is placed against a target surface, the plurality of hollow protrusions prevent contact between the substance and the target surface until the portion is deformed at the target surface.

With regard to the second side of the material, in the limiting circumstance, the substance fills the depressions to a point at or slightly below the uppermost edge of the depressions, particularly if a meniscus is formed wherein the substance decreases in thickness with increasing distance from the surface of the depressions. The substance has a surface below the outermost edge of the plurality of depressions, so that when a portion of the second side of the piece of deformable material is placed against a target surface, the plurality of depressions prevent contact between the substance and the target surface until the portion is deformed at the target surface.

Sheet materials utilized as a carrier material may be made from films comprising homogeneous resins or blends thereof. Single or multiple layers within the film structure are contemplated, whether co-extruded, extrusion-coated, laminated or combined by other known means. The key attribute of the sheet material is that it be formable to produce protrusions and valleys. Useful resins include polyethylene, polypropylene, PET, PVC, PVDC, latex structures, nylon, etc. Polyolefins are generally preferred due to their lower cost and ease of forming. Other suitable materials include aluminum foil, coated (waxed, etc.) and uncoated paper, coated and uncoated nonwovens, scrims, meshes, wovens, nonwovens, and perforated or porous films, and combinations thereof.

Further, the sheet materials may permit vapors to escape from the interior of the applicator and/or enter the applicator (i.e., be breathable) while still preventing liquids from passing therethrough.

Materials regarded as "breathable" in the context of the present invention include not only those materials which are apertured, microapertured, or otherwise rendered physically porous, but also substantially non-porous "monolithic" polymeric materials (typically films) made from such materials as polyurethanes, block poly-ether-amides, block polyesters, EVA, ethylene/acrylic esther copolymers, and PVP copolymers. Suitable materials include films formed from a block polyether copolymer such as a block polyether ester copolymer, a polyetheramide copolymer, a polyurethane copolymer, a poly(etherimide) ester copolymer, polyvinyl alcohols, or a combination thereof. Preferred copolyether ester block copolymers are segmented elastomers having soft polyether segments and hard polyester segments, as disclosed in Hagman, U.S. Pat. No. 4,739,012. Suitable copolyether ester block copolymers are sold by DuPont under the name Hytrel®. Hytrel® is a registered trademark of DuPont. Suitable copolyether amide polymers are copolyamides available under the name Pebax® from Atochem Inc. of Glen Rock, N.J., USA. Pebax® is a registered trademark of Elf Atochem, S.A. of Paris, France. Suitable polyurethanes are thermoplastic urethanes available under the name Estane® from The B.F. Goodrich Company of Cleveland, Ohio, USA. Suitable copoly(etherimide) esters are described in Hoeschele et al. U.S. Pat. No. 4,868,062. Such materials are regarded as breathable in contrast to substantially non-breathable materials such as non-apertured polyethylene films. Breathability may be determined by any suitable test method, such as, for example, the ASTM E-96 "Upright Cup" method. The substance delivery systems of the present invention, as described in detail below, are believed to provide particular advantages in terms of unoccluded breathable surface area versus conventional substance delivery systems.

In the present invention, the term "substance" can mean a flowable substance which is substantially non-flowing prior to delivery to a target surface. "Substance" can also mean a material which doesn't flow at all, such as a fibrous or other interlocking material. "Substance" may mean a fluid or a solid. "Substance" is defined in this invention as any material capable of being held in open valleys and/or depressions of a three dimensional structure. Adhesives, electrostatics, mechanical interlocking, capillary attraction, surface adsorption, van der Waals forces, and friction, for example, may be used to hold the substances in the valleys and/or depressions. The substances are intended to be at least partially released therefrom when exposed to contact with external surfaces or when the three dimensional structure is deformed, heated, or otherwise activated. Of current interest in the present invention include substances such as gels, pastes, foams, powders, agglomerated particles, prills, microencapsulated liquids, waxes, suspensions, liquids, and combinations thereof.

The term "deformable material" is intended to include foils, polymer sheets, cloth, wovens or nonwovens, paper, cellulose fiber sheets, co-extrusions, laminates, and combinations thereof. The properties of a selected deformable material can include, though are not restricted to, combinations or degrees of being: porous, non-porous, microporous, gas or liquid permeable, non-permeable, hydrophilic, hydrophobic, hydroscopic, oleophilic, oleophobic, high critical surface tension, low critical surface tension, surface pre-textured, elastically yieldable, plastically yieldable, electrically conductive, and electrically non-conductive.

In accordance with the present invention, the substance utilized in combination with the deformable material exhibits a selection of physical properties which enable it to be dispensed from its protected orientation within the threedimensional structure and applied to the target surface. Such dispensation may be partial, or substantially or totally complete in nature.

To facilitate such dispensing, substance properties which are believed to be important include the relative affinity of the substance for the target surface versus that for the deformable material and the apparent viscosity or flowability of the substance after activation of the three-dimensional structure. It is presently believed that the substance should preferentially adhere to the target surface to a greater extent than to the deformable material and/or to a greater extent than for other portions of the substance itself. Said differently, the substance has a greater affinity for the target surface than for itself and/or for the deformable sheet material.

Substances may inherently possess viscosity and flow characteristics which permit their liberation from their protected location within the sheet material or may require viscosity modification to permit liberation and dispersal. Viscosity modification may be obtained by the selection of substances which undergo a change in viscosity in response to the mode of activation selected. For example, for a mechanical activation such as a compressive force it may be desirable, and preferably, to employ substances which are commonly referred to as "shear-thinning" (pseudoplastic) substances. Examples of such substances include polymer solutions, many gels and pastes such as dentrifice and body creams, paints, gelled wood stains, etc. Other materials behave as shear-thinning materials only after a certain threshold shear (yield stress) is reached or exceeded. Such materials are commonly referred to as Bingham plastic materials, and one common example of a substance exhibiting such behavior is the type of condiment known as ketchup. Substances which are thermally-responsive (i.e., reduce/change viscosity in response to changes in temperature) may also be employed, such as substances (petrolatum, etc.) which exhibit lower viscosity with increased temperature produced by mechanical friction or other sources.

Some of the factors believed to influence the adhesion or affinity of the substance for the target surface include: electrostatic or electrical charges; chemical bonds via hydrogen bonding, covalent bonding, ionic bonding, partial ionic bonds (partial dipolar attraction), van der Walls forces, osmotic forces, etc.; capillary pressure (suction); adsorption; absorption; vacuum/suction; etc. Other important factors include the wettability of the substance upon the target surface, as reflected by the contact angle of the substance on the target surface.

To facilitate spreading or dispersal of the substance upon the target surface, particularly to counteract the tendency of the substance to remain in a localized distribution pattern given the localized orientation upon the deformable substance, it is presently preferred to utilize substances which are tailored so as to be wettable on the target surface. Other factors which may aid in dispersion or distribution of the substance upon the target surface include the use of substances which exhibit a shear-thinning behavior, as well as mechanical spreading action provided by the user of the composite sheet material to impart a lateral mechanical motion after activation but prior to removal of the deformable material from the target surface. Such lateral mechanical action may also provide additional interaction with the substance such as for shear-thinning substances and may provide additional benefits such as lathering, foam generation, scrubbing/abrasive action, etc.

Successful dispersal occurs when a portion of the deposited or dispensed substance subsequently coats a portion of the target surface where the substance was not originally deposited. Upon removal of the sheet material from the target surface, at least some of the substance remains located on the target surface, preferably in a substantially-uniform fashion.

As discussed above, a wide variety of substances may be selected for use in accordance with the principles of the present invention. Representative substances for illustrative purposes include cleansing agents such as soaps and detergents, emollients such as lotions, medicinal agents such as ointments, anti-inflammatory creams, etc., health and beauty care products, including antiperspirants, deodorants, cosmetics, fragrances, and the like. Other more diverse applications for such a sheet material include applicators for automotive and household products such as lubricants, colorants, protectants such as oils and waxes, adhesives, preservatives, and the like, as well as food-oriented applications such as condiments (mustard, ketchup, etc.).

Multiple substances may also be employed which are not only protected from inadvertent contact but segregated from one another initially (on the same face of, or on opposing faces of, the sheet material) and be commingled during the activation process or during subsequent dispensing and/or dispersion operations. Such an arrangement may be particularly useful for substances which beneficially interact with one another (e.g., co-dispensing epoxies, catalyzed reactions, etc.) to provide additional functionality with each other and/or with the target surface.

Figure 5:
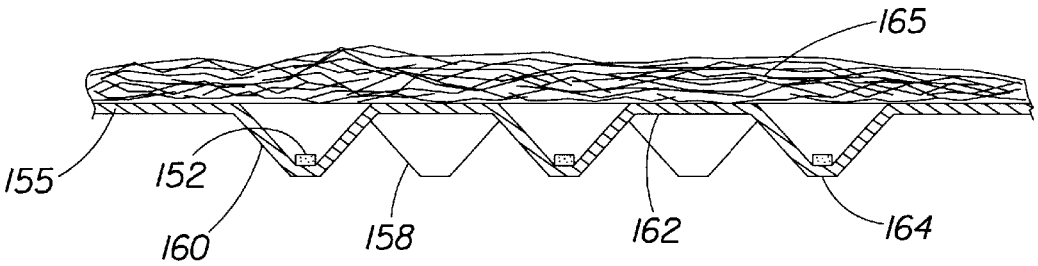
FIG. 5 is another embodiment of a material in accordance with the present invention, including a porous material spanning the protected substance.

FIG. 5 depicts another embodiment of a material in accordance with the present invention, structurally similar to that depicted in FIG. 4, including protrusions 158 with outermost ends 164 and lands 162 therebetween. However, in addition to the structural elements of FIG. 4 the material of FIG. 5 includes an additional structural element in the form of one or more layers of a porous material 165 which overlies the protected substance 152 from the side opposite to that protected by the sheet material 155. Porous material 165 may be any material sufficiently porous as to not block or significantly impair the ability of the substance 152 to be dispensed from the sheet material onto the target surface, against which the porous material would be placed. Porous materials may comprise, as depicted in FIG. 5, a fibrous material such as a woven or nonwoven material, a scrim or meshlike material, a porous or apertured film or the like, of similar or diverse composition to that of the sheet material itself. Any of the aforementioned types of sheet-like materials may be utilized. The inclusion of such a porous material provides additional protection for the substance prior to activation of the sheet material and may provide additional distributive benefit to more evenly disperse the substance onto the target surface particularly when translational motion of the sheet material is also employed. The porous material may also provide additional interaction with the substance such as for shear-thinning substances and may provide additional benefits such as lathering or foam generation, etc. One application envisioned for such a structure would be a cleansing cloth which provides its own source of cleansing agent. The porous material may also contain a substance for distribution, which may desirably interact with, augment, or otherwise be usable in conjunction with the substance within the three-dimensional sheet material.

Figure 6:
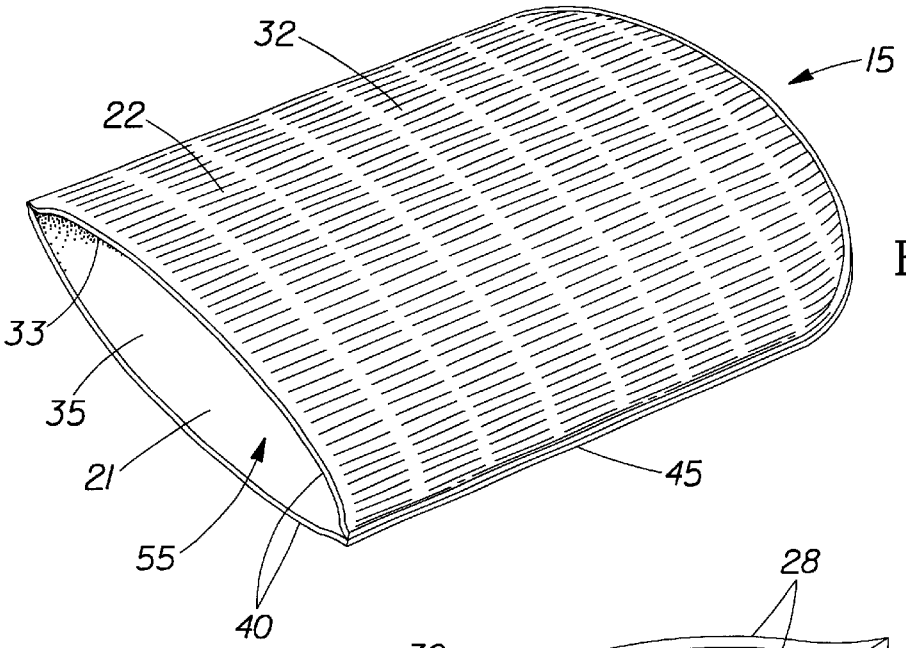
FIG. 6 is another embodiment of a semi-enclosed applicator in accordance with the present invention, in the form of a mitt.

FIG. 6 shows a mitt 15 comprising a back panel 22 connected to a front panel 21 that defines a hollow interior into which a hand may be inserted through opening 55. The back panel 22 and the front panel 21 are connected along a portion of the periphery 45. The back panel 22 further comprises an outer surface 32 and an inner surface 33 that is opposite the outer surface 32 and is immediately adjacent to the back of a user's hand during use. The front panel 21 also further comprises an outer surface (not shown) and an inner surface 35 that is opposite the outer surface and is immediately adjacent to the palm of a user's hand during use. Thus a wearer's hand is covered by the interior surfaces of the front panel 21 and back panel 22 for application of a substance contained within the sheet material of the front and/or back panels. As show in FIG. 6, surface embossments may be utilized for desirable stretch or tactile properties, or as part of the dispensing function comparatively more elongated protrusions may be employed than those depicted in FIGS. 1–4.

In use, a wearer of the mitt 15 inserts a hand into the hollow interior through the provided opening 55 wherein the back panel 22 contacts the back of the wearer's hand and the inner surface 35 of the front panel 21 contacts the wearer's palm. As the construction of the mitt 15 is more generic than a glove with defined anatomically-conforming geometry, the mitt may be used for either hand and/or may be appropriately sized to fit the foot of a wearer or any other bodily extremity. As discussed previously, shape-corresponding applicators like the glove of FIG. 1 may be designed and adapted for various uses such as foot or head coverings, or condoms, or more generically-shaped applicators like mitt 15 may likewise be designed for many applications.

If desired, at the end of its use, the mitt can be everted by making a fist with the mitt-hand, pulling the structure over the fist from the back edge 40 of the mitt 15. Thus the layers are transposed, and the inner surface 35 of the front panel 21 and the inner surface 33 of the back panel 22 become the outer surfaces of the now waste article. More simply stated, the mitt is turned inside out after its use and then thrown away. That is, the wearer makes a fist, and with his or her other hand, grasps a point on the back edge 40 and carefully pulls the fisted hand toward the open mouth of the mitt 15, until the entire end of the mitt 15 is pulled through the opening 55.

Figure 7:
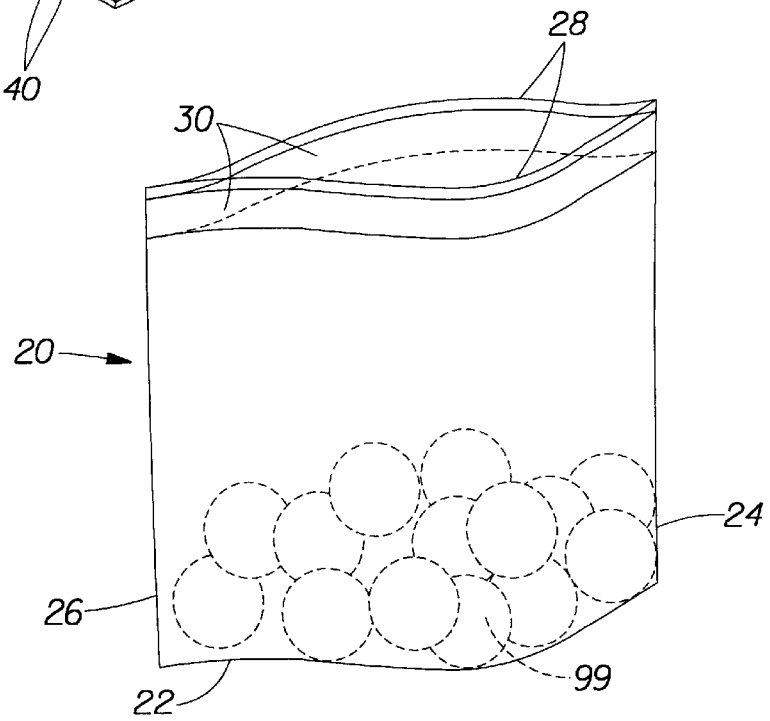
FIG. 7 is yet another embodiment of a semi-enclosed applicator in accordance with the present invention, in the form of a flexible bag which is convertible to a fully-enclosed applicator.

FIG. 7 depicts a representative embodiment of a flexible bag 20 suitable for use as a semi-enclosed applicator which is convertible to a fully-enclosed applicator according to the present invention. In the embodiment depicted in FIG. 7, the flexible bag 20 includes a bag body formed from a piece of flexible sheet material folded upon itself along fold line 22 and bonded to itself along side seams 24 and 26 to form a semi-enclosed container having an opening along edge 28. Flexible bag 20 also includes closure means 30 located adjacent to edge 28 for sealing edge 28 to form a fully-enclosed container or vessel. Closure means 30 may be selectively openable, sealable, and resealable, and may be constructed in any known fashion utilizing any closure configuration, such as folds, pleats, adhesives, or mechanical interlocking closures such as ribs, beads, and grooves, which are known in the art. Bags such as the flexible bag 20 of FIG. 7 can be also constructed from a continuous tube of sheet material, thereby eliminating side seams 24 and 26 and substituting a bottom seam for fold line 22.

Flexible bag 20 is suitable for containing and protecting a wide variety of materials and/or objects contained within the bag body and applying a substance to them as described above. FIG. 7 depicts the bag 20 in an open condition wherein the closure means 30 has been released such that edge 28 may be opened to admit materials and/or objects into the interior of the bag body portion of the bag 20. In FIG. 7 a plurality of generic solid objects 99 are shown within the bag 20.

Once the desired sheet materials are manufactured in any desirable and suitable manner, comprising all or part of the materials to be utilized for the bag body, the bag may be constructed in any known and suitable fashion such as those known in the art for making such bags in commercially available form. Heat or adhesive sealing technologies may be utilized to join various components or elements of the bag to themselves or to each other. In addition, the bag bodies may be thermoformed, blown, or otherwise molded rather than reliance upon folding and bonding techniques to construct the bag bodies from a web or sheet of material. Two recent U.S. Patents which are illustrative of the state of the art with regard to flexible storage bags similar in overall structure to those depicted in FIGS. 1 and 2 but of the types currently available are U.S. Pat. Nos. 5,554,093, issued Sep. 10, 1996 to Porchia et al., and U.S. Pat. No. 5,575,747, issued Nov. 19, 1996 to Dais et al.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A semi-enclosed, substance delivery applicator comprising:

(a) a sheet of material formed into a three-dimensional structure having a first side and a second side, said first side having outermost surface features and spaces therebetween said outermost surface features for containing a substance, said substance having a level internal to said outermost surface features such that said substance is protected from inadvertent contact with external surfaces, said three-dimensional structure forming at least a portion of a semi-enclosed applicator body having at least one opening and an internal cavity; and (b) a substance having substantial resistance to flow prior to delivery to a target surface, occupying said spaces of said first side, said substance remaining protected until said three-dimensional structure is sufficiently deformed into a substantially two-dimensional structure and said substance is thereby exposed to contact a surface of an object without compliance of said surface being necessary, said substance having an effective viscosity upon activation which permits said substance to be liberated from said location and dispensed onto said surface of said object.

2. The substance delivery applicator of claim 1, wherein said spaces are interconnected.

3. The substance delivery applicator of claim 1, wherein said spaces are discrete.

4. The substance delivery applicator of claim 1, wherein said substance exhibits a greater flowability after said three-dimensional structure is deformed.

5. The substance delivery applicator of claim 1, wherein said applicator dispenses said substance inwardly of said applicator toward said cavity.

6. The substance delivery applicator of claim 1, wherein said applicator dispenses said substance outwardly of said applicator.

7. The substance delivery applicator of claim 1, wherein said applicator further comprises a sheet of porous material such that said substance is located between said three-dimensional structure and said sheet of porous material and may be dispensed through said sheet of porous material.

8. The substance delivery applicator of claim 1, wherein said applicator dispenses a substance both inwardly of said applicator toward said cavity and outwardly of said applicator.

9. The substance delivery applicator of claim 1, wherein said substance is selected from the group consisting of cleansing agents, medicinal agents, emollients, lubricants, colorants, preservatives, protectants, condiments, adhesives, fragrances, anti-perspirants, deodorants, and combinations thereof.

10. The substance delivery applicator of claim 1, wherein said applicator includes at least two substances of diverse composition.

* * * * *

US006257785C1

(12) REEXAMINATION CERTIFICATE (4839th)

United States Patent

Otten et al.

(10) Number: US 6,257,785 C1

(45) Certificate Issued: Aug. 26, 2003

(54) SEMI-ENCLOSED APPLICATOR UTILIZING A SELECTIVELY-ACTIVATIBLE SHEET MATERIAL FOR DISPENSING AND DISPERSING A SUBSTANCE ONTO THE SURFACE OF A TARGET OBJECT

(75) Inventors: Geneva G. Otten, Cincinnati, OH (US); Richard Tweddell, III, Cincinnati, OH (US); Kenneth S. McGuire, Wyoming, OH (US); Peter W. Hamilton, Cincinnati, OH (US)

(73) Assignee: The Procter & Gamble Company, Cincinnati, OH (US)

Reexamination Request:
No. 90/006,194, Jan. 16, 2002

Reexamination Certificate for:

| | |
|---|---|
| Patent No.: | **6,257,785** |
| Issued: | **Jul. 10, 2001** |
| Appl. No.: | **09/369,742** |
| Filed: | **Aug. 6, 1999** |

Related U.S. Application Data

(63) Continuation-in-part of application No. 08/745,339, filed on Nov. 8, 1996, now Pat. No. 5,965,235.

(51) Int. Cl.[7] ..... A46B 5/04

(52) U.S. Cl. ..... 401/7; 401/261; 401/264

(58) Field of Search ..... 401/7, 266, 261, 401/201, 264, 25; 15/227, 104.93, 104.94; 428/173, 174, 156, 179

(56) References Cited

U.S. PATENT DOCUMENTS

| | | | | |
|---|---|---|---|---|
| 4,670,930 | A | * | 6/1987 | Lu |
| 4,739,012 | A | | 4/1988 | Hagman |
| 4,775,372 | A | * | 10/1988 | Wilberg |
| 4,868,062 | A | | 9/1989 | Hoeschele et al. |
| 4,902,283 | A | * | 2/1990 | Rojko et al. |
| 4,953,250 | A | * | 9/1990 | Brown |
| 4,959,881 | A | * | 10/1990 | Murray |
| 5,473,789 | A | * | 12/1995 | Oster |
| 5,518,801 | A | | 5/1996 | Chappell et al. |
| 5,554,093 | A | | 9/1996 | Porchia et al. |
| 5,575,747 | A | | 11/1996 | Dais et al. |
| 5,650,214 | A | | 7/1997 | Anderson et al. |
| 5,662,758 | A | | 9/1997 | Hamilton et al. |
| 5,871,607 | A | | 2/1999 | Hamilton et al. |
| 5,965,235 | A | | 10/1999 | McGuire et al. |
| 5,968,633 | A | | 10/1999 | Hamilton et al. |
| 6,018,837 | A | * | 2/2000 | Andreu |
| 6,099,940 | A | | 8/2000 | Hamilton et al. |
| 6,194,062 | B1 | | 2/2001 | Hamilton et al. |

* cited by examiner

*Primary Examiner*—Charles R. Eloshway

(57) ABSTRACT

A semi-enclosed, substance delivery applicator comprising: (a) a three-dimensional structure having outermost surface features and spaces between the outermost surface features for containing a substance, the substance having a level internal to the outermost surface features such that the substance is protected from inadvertent contact with external surfaces, the three-dimensional structure forming at least a portion of a semi-enclosed applicator body having at least one opening and an internal cavity; and (b) a substance, having substantial resistance to flow prior to delivery to a target surface, occupying the spaces of the three-dimensional structure, the substance remaining protected until the three dimensional structure is sufficiently deformed into a substantially two dimensional structure and the substance is thereby exposed to contact a surface of an object without compliance of the surface being necessary, the substance having an effective viscosity upon activation which permits the substance to be liberated from the location and dispensed onto the surface of the object. The substance may be dispensed inwardly of the applicator, outwardly of the applicator, or both. The applicator may take the form of a glove or mitt.

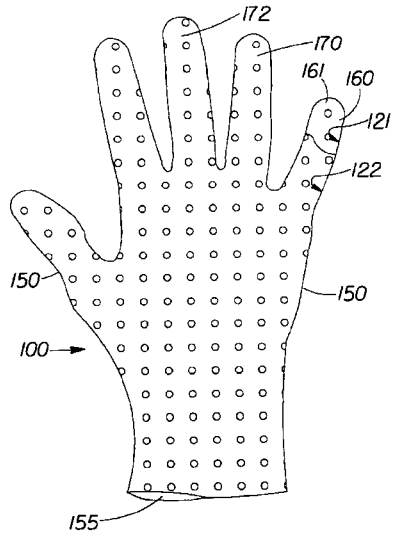

REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

ONLY THOSE PARAGRAPHS OF THE SPECIFICATION AFFECTED BY AMENDMENT ARE PRINTED HEREIN.

Column 1, line 6:

*Related Application*

*This Application is a continuation-in-part of Ser. No. 08/745,339, filed Nov. 8, 1996, now U.S. Pat. No. 5,965,235, the entire disclosure of which is hereby incorporated by reference herein.*

AS A RESULT OF REEXAMINATION, IT HAS BEEN DETERMINED THAT:

The patentability of claims 1–10 is confirmed.

* * * * *